United States Patent [19]

Amacker

[11] Patent Number: 4,669,194

[45] Date of Patent: Jun. 2, 1987

[54] ARCHERY BOW SIGHT AND METHOD OF SIGHTING AN ARCHERY BOW

[76] Inventor: Joseph A. Amacker, Rte. 3, Box 41, Tallulah, La. 71282

[21] Appl. No.: 746,667

[22] Filed: Jun. 20, 1985

[51] Int. Cl.[4] ..... F41G 1/46

[52] U.S. Cl. ..... 33/265; 124/87

[58] Field of Search ..... 33/265; 124/87

[56] References Cited

U.S. PATENT DOCUMENTS

| | | | |
|---|---|---|---|
| 2,767,472 | 10/1956 | Kocur | 33/265 |
| 3,136,063 | 6/1964 | Stebbins | 33/265 |
| 3,871,105 | 3/1975 | Brougham | 33/265 |
| 3,945,127 | 3/1976 | Spencer | 33/265 |
| 4,026,032 | 5/1977 | Smith | 33/265 |
| 4,136,462 | 1/1979 | Topel | 33/265 |
| 4,263,718 | 4/1981 | Smith | 33/265 |

*Primary Examiner*—Willis Little

*Attorney, Agent, or Firm*—Wigman & Cohen

[57] ABSTRACT

The present invention relates to an archery bow sight having a bracket mounted at the mid-section of the box. The bracket has a pair of vertical parallel slots therein, and a plurality of horizontally and vertically adjustable sight pins are mounted within the vertical slots of the bracket. Each sight pin in the first vertical slot is aligned with a sight pin in the second vertical slot so that it can be used to sight a target at a specific distance from the bow, and each pair of sight pins is adjusted for sighting targets at different distances from the bow. When using the sight of the present invention, the archer first estimates the distance between the target and the bow, and then determines which pair of sight pins is best adjusted for a target at that distance. The archer then sights the target using the properly adjusted pair of sight pins.

13 Claims, 6 Drawing Figures

ARCHERY BOW SIGHT AND METHOD OF SIGHTING AN ARCHERY BOW

BACKGROUND OF THE INVENTION

The present invention relates to an archery bow sight and a method of using the same and, more particularly, to an archery bow sight which can be used to aim the bow at a target without adjustment, regardless of the target range, i.e., the distance between the target and the bow.

Arrows shot from a bow are difficult to aim because of the extent of the vertical drop experienced by the arrow owing to gravity as it travels from the bow to a target. The extent of the vertical drop is proportional to the horizontal distance travelled and the velocity of the arrow. Accordingly, for an archery bow sight to be accurate it must be designed to account for the amount of vertical drop an arrow will experience before it reaches the intended target.

A search of the prior art failed to uncover any prior art reference which discloses the archery bow sight and method of the present invention. However, several prior art patents were uncovered which disclose various types of bow sights. For example, U.S. Pat. Nos. 2,559,927; 3,871,105; and 4,215,484 disclose archery bow sights having single front and rear sighting means which are vertically adjustable so that the distance between the bow and the target may be taken into account while aiming.

Those prior art devices are generally unsatisfactory in that the sights must be manually adjusted depending upon the target range, i.e., the distance between the target and the bow. The need for such an adjustment is particularly troublesome and unsatisfactory when an archer is attempting to sight a movable target, such as a deer, for example, which is likely to quickly retreat from the bow as the archer takes aim. In such a situation, the archer would have to frequently make manual adjustments of the sight in order to accurately aim at the moving target.

U.S. Pat. Nos. 2,767,472; 3,234,651; 3,590,489; 3,696,517; 4,170,071; 4,332,231; and 4,440,887 each disclose archery bow sights comprising a plurality of single point, vertically spaced individual sighting means. A user of such a sight determines which of the vertically spaced sighting means would be most appropriate based upon target range and then aligns that sighting means with the target.

Although the aforementioned prior art vertically spaced sighting devices do not need to be adjusted, as do the aforedescribed prior art front and rear sighting means, they are disadvantageous in that they only provide a single point sighting means. As a result, accuracy is likely to be substantially reduced.

Also known in the art is the use of a plurality of single point, vertically spaced forward sighting means mounted on the midpoint of a bow and adapted to be aligned with a single rear sighting means mounted on the string of the bow. A disadvantage of that system is that it is difficult to mount a satisfactory rear sighting means on the bow string.

OBJECTS AND SUMMARY OF THE INVENTION

In view of the foregoing limitations and shortcomings of the prior art devices, as well as other disadvantages not specifically mentioned above, it should be apparent that there still exists a need in the art for an improved sight for an archery bow that can be used to more accurately aim the bow at a target, without adjustment, regardless of target. It is, therefore, a primary object of this invention to fulfill that need by providing an archery bow sight having a plurality of forward and a plurality of rearward sighting means.

More particularly, it is an object of this invention to provide an archery bow sight with improved accuracy and which can be used in a manner to account for the distance between the target and the bow without requiring any adjustment of the sight.

It is a further additional obiect of this invention to provide a sight that can be used to easily sight and track a movable target that is retreating from the bow.

It is still another object of this invention to provide a sight for an archery bow that can be used to aim the bow at a target that is at a different altitude from the bow.

It is yet another object of the present invention to have color coded forward and rearward sighting means which are to be aligned for sighting targets at different distances corresponding to the color of the sighting means.

Briefly described, these and other objects are accomplished according to the present invention by providing an archery bow sight comprising a sight bracket mounted at the mid-section of the bow. The sight bracket has a pair of vertical, parallel slots therein, and a plurality of horizontally and vertically adjustable sight pins are mounted in the vertical slots of the bracket.

Each sight pin in the first vertical slot is aligned with a sight pin in the second vertical slot so that it can be used to sight a target at a predetermined distance from the bow, and each pair of sight pins is adjusted for sighting a target at a different distance from the bow. Preferably, the distances are selected such that the effective range of the bow is evenly distributed among the pairs of sight pins. Each pair of sight pins may be color coded to be easily identified with its respective distance.

According to the method aspects of the invention, when using the sight, the archer first estimates the distance between the target and the bow, then determines which pair of sight pins is set to a range which corresponds most closely to target range and then aims the bow at the target using the selected pair of sight pins.

With the foregoing and other objects, advantages and features of the invention that will become hereinafter apparent, the nature of the invention may be more clearly understood by reference to the following detailed description of the invention, the appended claims and to the several views illustrated in the attached drawings.

DETAILED DESCRIPTION OF A PREFERRED EMBODIMENT

Figure 1:
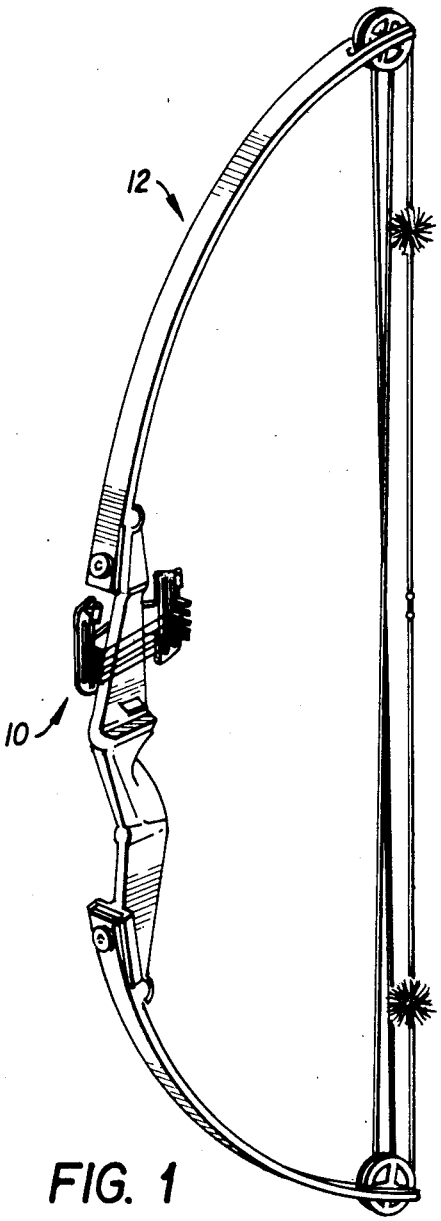
FIG. 1 is a perspective view of an archery bow having the sight of the present invention mounted thereon.

Referring now in detail to the drawings, there is shown in FIG. 1 a perspective view of a conventional archery bow 12 with a bow sight constructed according to the present invention and designated generally by reference numeral 10. The sight 10 is mounted on the bow near its midsection at a point slightly above the handle of the bow that is gripped by the archer and the part of the bow which the arrow crosses when shot.

Figure 2:
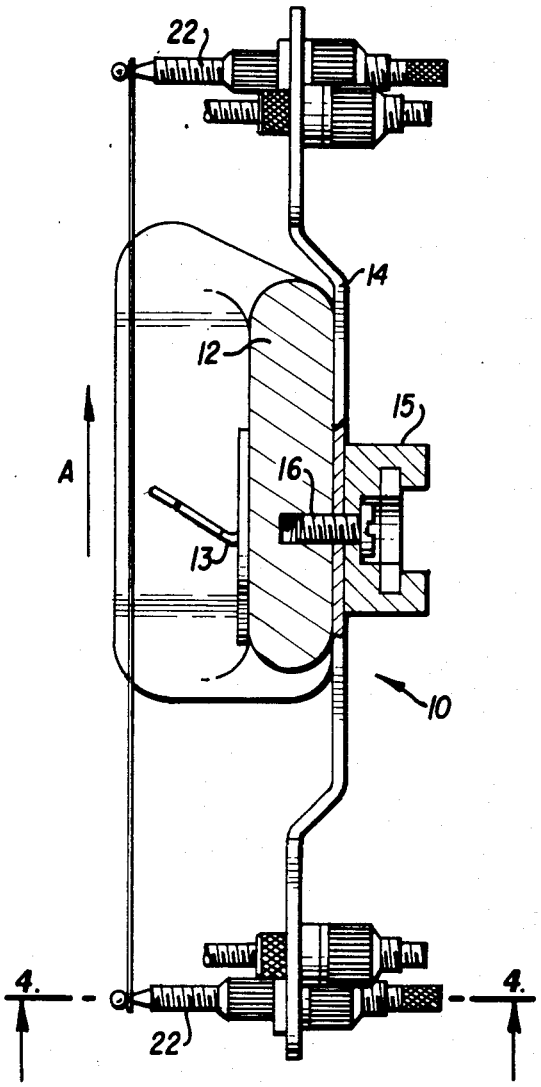
FIG. 2 is a top view of the sight of the present invention partly in cross-section.
Figure 3:
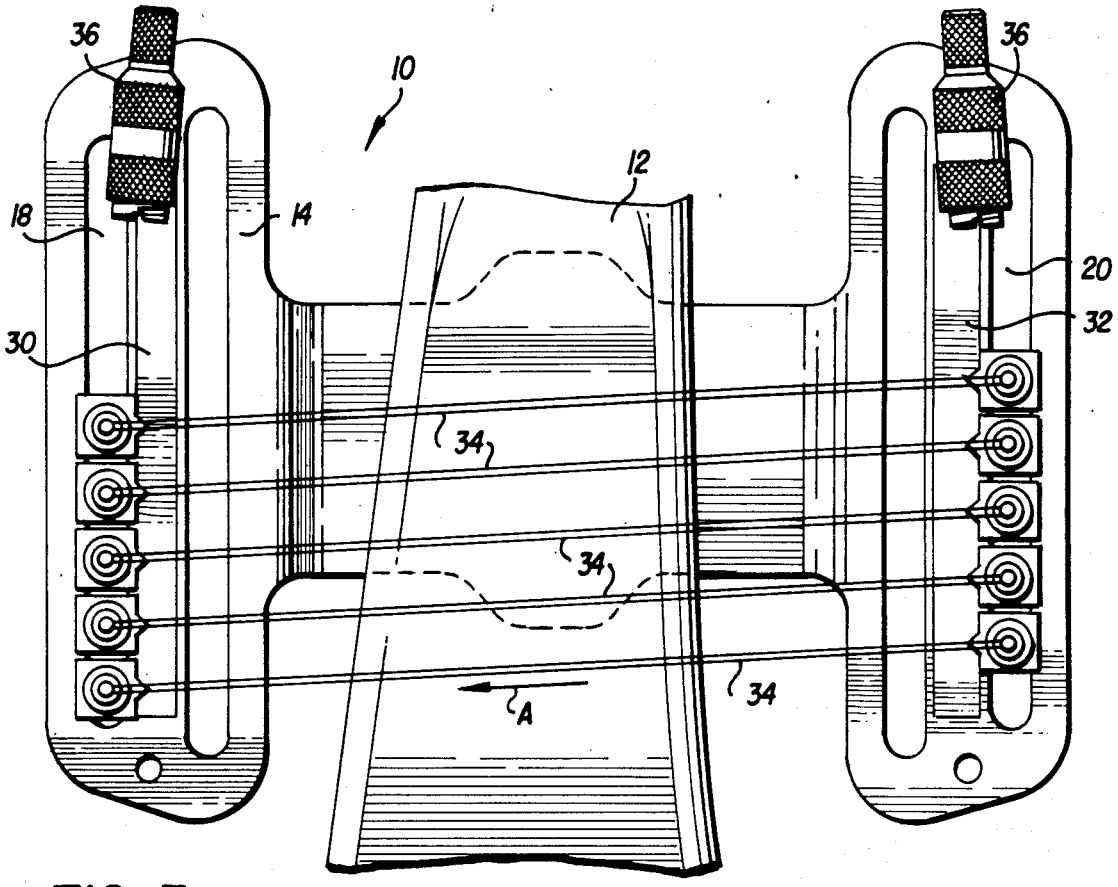
FIG. 3 is a side elevational view of the sight according to the present invention.

A more detailed view of the sight 10 is shown in FIG. 2, which is a top view of the sight 10 and includes a cross-sectional view of the bow 12 upon which the sight 10 is mounted. As best seen in FIGS. 2 and 3, the sight 10 includes a bracket 14 which is mounted to the bow 12 by screws 16, only one of which is shown in the drawings. Also shown in FIG. 2, are a conventional arrow guide 13 and quiver holder 15.

Figure 4:
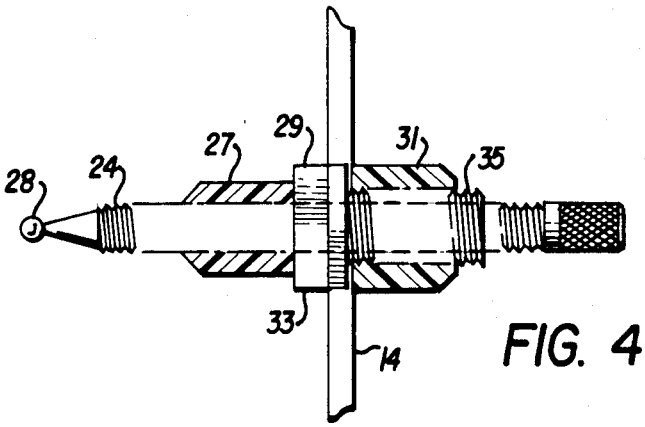
FIG. 4 is a detail view partly in cross-section of a sight pin used on the sight of the present invention.

The bracket 14 is generally H-shaped, having two vertical sections joined by a cross-piece. There is a forward vertical slot 18 in the forward vertical section and a rearward vertical slot 20 in the rearward vertical section, as shown in FIG. 3. Mounted in each slot 18, 20 are a plurality of vertically adjustable sight pins 22. Referring to FIG. 4, pin 22 comprises a threaded shaft 24, which is threaded into a three part plastic base 26. The base 26 comprises a nut 27, a spacer 29, and a nut 31. The spacer 29 includes a flat square disc 33 integrally connected to a tube 35 that is threaded both internally and externally. To attach the base 26 and pin 22 to the bracket 14, the spacer 29 is threaded onto shaft 24 of the pin 22. The spacer 29 is then inserted through slot 18, 20 and the nuts 27 and 31 are threaded onto the pin shaft 24 and the spacer 29, respectively, to lock the base 26 and pin 22 in place on the bracket 14.

The sight pins 22 can be vertically adjusted on the bracket 14 by loosening the components 27, 29, 31 of the base 26 and moving the pin 22 within its respective slot 18, 20. The pins 22 can also be horizontally adjusted in a direction transversely of the line of sight by threading the shafts 22 into or out of the base 26.

Each sight pin 22 has a bead 28 on one end thereof. The beads 28 are preferably spherical, although other shapes, such as voids and solid geometrical shapes may be used. It is greatly preferred that the beads 28 on the pins 22 in the rearward slot 20 are smaller in diameter than the beads 28 on the pins 22 in the forward slot 18 to facilitate aiming the bow as described in greater detail hereinafter in connection with FIG. 6.

Before the sight 10 can be used, the individual sight pins 22 must be adjusted. The forward and rearward sight pins 22 are arranged in pairs that are approximately horizontally opposed. An arbitrary distance to a potential target from the bow is assigned to each pair of forward and rearward sight pins 22. Preferably, the distances are selected such that the effective range of the bow is evenly distributed among the pairs of sight pins. For example, if there are five pairs of sight pins and the range of the bow is one hundred yards. The sight pin pairs may be designated for twenty, forty, sixty, eighty, and one hundred yards, respectively. Each pair of sight pins is then adjusted by the archer in a conventional manner so that it is accurately aligned for aiming the bow at a target at the assigned target range.

As best seen in FIG. 3, adjacent each vertical slot 18, 20 is a thin strip 30, 32 of bracket surface that has been painted or otherwise specially treated to facilitate marking thereon. The distances for which each pair of sight pins have been adjusted can be marked on the strips 30, 32. Also, reference marks can be made on the strips 30, 32 to aid the archer in making subsequent adjustments of the sight pins 22.

Another feature of the present invention is color coding of the beads 28 of each sight pin 22. The beads 28 of each pair of sight pins 22 are the same color, and each pair of beads is a color different from the color of the other pairs of beads. Thus, an archer using the sight 10 of the present invention would associate a particular color with a predetermined range and would not need to refer to the strips 30, 32 to determine which pair of sight pins 22 to use.

To further facilitate the use of the sight 10, colored elastic bands 34 interconnect the bead ends of the sight pins 22 as seen in FIG. 3 to aid in forming the line of sight between the beads 28. The colors of the bands 34 preferably correspond to the color coding of the beads 28.

The sight 10 of the present invention can also include a soft light 36, preferably red, mounted above each slot 18, 20 for illuminating the beads 28 at night or in subdued lighting. The lights 36 are of a conventional battery-powered type.

Figure 5:
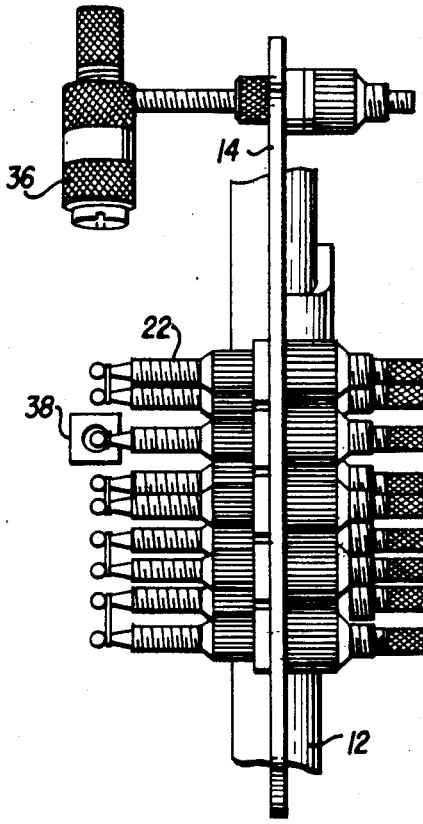
FIG. 5 is a rear view of the sight as seen by the archer when using the bow.
Figure 6:
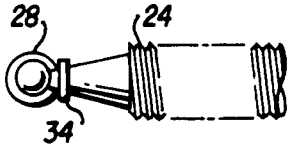
FIG. 6 is a detail view of a pair of sight pins in proper alignment for predetermined target range.

To use the sight 10 of the present invention, the archer estimates the distance between an intended target and the bow (target range), and then forms a line of sight (arrow A in FIGS. 2 and 3) between the pair of pins 22 that most clearly correspond to the estimated target range. The archer then aligns the line of sight thus formed with the target. In FIG. 5, the pair of pins 22, second from the top, have been so aligned with a target 38. FIG. 6 is an enlarged detail view of the two beads 28 in FIG. 5 that are in alignment. Should the range to the target 38 increase or decrease, the archer will elevate or depress the line of sight of the bow 12 until the pair of pins 28 corresponding to the new target range is in alignment with the target 38. This is advantageous in that the various pairs of pins 22 have previously been adjusted to correct for the vertical drop of the arrow owing to gravity over the distance.

The sight 10 according to the present invention is also advantageous in that it can be accurately used when shooting at a target that is at a different altitude from the archer. For example, when shooting at a ground level target from a raised platform, the sight 10 of the present invention can be used without additional adjustment.

Although only preferred embodiments are specifically illustrated and described herein, it will be appreciated that many modifications and variations of the present invention are possible in light of the above teachings and within the purview of the appended claims without departing from the spirit and intended scope of the invention.

What I claim is:

1. A sight for a bow and the like, comprising:

bracket means mounted on the bow;

a plurality of forward means for sighting;

a plurality of rearward means for sighting;

said forward and rearward sighting means comprising a sight pin that is vertically and horizontally adjustable within the holding means:

a first vertical means on the bracket means for holding the forward sighting means;

a second vertical means on the bracket means for holding the rearward sighting means parallel to the first holding means;

wherein each of the forward sighting means cooperate with a respective rearward sighting means for sighting a target at a specific distance from the bow, and each pair of forward and rearward sighting means are thus disposed in the vertical holding means for sighting a target at a different distance from the bow further comprising bands interconnecting respective forward and rearward sighting means.

2. The sight according to claim 1, wherein the bead on each forward sight pin is larger than the bead on each rearward sight pin.

3. The sight according to claim 1, further comprising means for lighting the sighting means.

4. The sight according to claim 1, wherein each holding means comprises a slot in the bracket means.

5. A sight for a bow and the like comprising:

bracket means mounted on the bow;

a plurality of forward means for sighting;

a plurality of rearward means for sighting;

a first vertical means on the bracket means for holding the forward sighting means;

a second vertical means on the bracket means for holding the rearward sighting means parallel to the first holding means;

wherein each of the forward sighting means cooperate with a respective rearward sighting means for sighting a target at a specific distance from the bow, and each pair of forward and rearward sighting means are thus disposed in the vertical holding means for sighting a target at a different distance from the bow, said forward and rearward sighting means comprising a sight pin that is vertically and horizontally adjustable within the holding means, said sight pin having a spherical bead, and the bead on each forward sight pin being larger than the bead on each rearward sight pin.

6. The sight according to claim 5 wherein each holding means comprises a slot in the bracket means.

7. The sight according to claim 5 further comprising means for ligthing the sighting means.

8. The sight according to claim 6 further comprising means on the bracket, adjacent each slot, for calibrating the different distances.

9. A bracket for use as a sight in an archery bow of the type in which sighting devices are inserted in a mounting means for sighting at a target wherein said mounting means comprises:

means for holding a plurality of front sighting devices on the target side of the bow, means for holding a plurality of rear sighting devices on the archer side of the bow, and means for attaching the bracket to the bow positioned between said front and rear holding means, whereby said front and rear holding means are adapted to receive front and rear sighting devices comprising a sight pin having a spherical bead, with the beads on the front sighting devices being larger than the beads on the rear sighting devices.

10. The bracket according to claim 9 wherein the sight pin is vertically and horizontally adjustable within the holding means.

11. The bracket according to claim 9 further comprising means for lighting the sighting means.

12. The bracket according to claim 9, wherein the holding means comprises a slot in the bracket.

13. The bracket according to claim 12, wherein means are provided adjacent each slot for cabilbrating the distance to the target.

* * * * *